United States Patent [19]

Clouthier

[11] 3,991,993

[45] Nov. 16, 1976

[54] DECOLLATOR FOR CONTINUOUS FORMS

[76] Inventor: Robert G. Clouthier, 421 Bullard St., Holden, Mass. 01520

[22] Filed: May 12, 1975

[21] Appl. No.: 576,645

[52] U.S. Cl. ..... 270/52.5
[51] Int. Cl.[2] ..... B65H 41/00
[58] Field of Search ..... 270/52.5

[56] References Cited

UNITED STATES PATENTS

| | | | |
|---|---|---|---|
| 2,280,224 | 4/1942 | Euth | 270/52.5 |
| 2,904,332 | 9/1959 | Metzner | 270/52.5 |
| 2,975,989 | 3/1961 | Hinman | 270/52.5 |
| 3,514,096 | 5/1970 | Muller | 270/52.5 |

FOREIGN PATENTS OR APPLICATIONS

| | | | |
|---|---|---|---|
| 730,633 | 5/1955 | United Kingdom | 270/52.5 |

*Primary Examiner*—Edgar S. Burr
*Assistant Examiner*—A. Heinz
*Attorney, Agent, or Firm*—Charles R. Fay

[57] ABSTRACT

A light weight decollator comprising an inclined wire rack located generally centrally of a wire support, the stack to be decollated being located at one side of the rack, the first separated part being delivered at the opposite side thereof. The inclined rack and a cooperating baffle rack guide the carbon paper to a roll and another part of the continuous form to a second stack. The inclined wire rack causes the separated form to "roll out" with a flowing S motion for smooth stacking.

11 Claims, 4 Drawing Figures

DECOLLATOR FOR CONTINUOUS FORMS

BACKGROUND OF THE INVENTION

Prior art decollators are referred to as "waterfall" types and are relatively large, heavy and expensive, so that many users of continuous forms prefer decollating by hand. This invention presents a small light weight machine that can be set on a table top or on a separate stand. The new device decollates two stacks at a time, and requires additional runs, through the decollator, for continuous form sets having two parts or more.

SUMMARY OF THE INVENTION

A horizontal wire rack support is secured to a support and one part of this horizontal rack is used to locate the initial forms stack, another part receiving the decollated forms in a stack.

A wire rack separates the stacks, the forms to be processed proceeding up and over the same. This rack is generally upright but is inclined extending up and away from the initial stack to a point above and intermediate the decollated stack. It carriers a splitter for separating paper locks and carbon glue and positions the decollated forms to descend to form a stack. The carbons and carbon paper are threaded to descend between a baffle rack and the inclined rack to a position beneath the forming stack of decollated forms, the carbons, or other parts of the continuous form set, stacking in a receptacle, and the carbon paper being wound on a disposable core on a power operated roll that provides the actuating force for traveling the continuous forms.

The angle of the inclined rack in cooperation with an offset at the top of the baffle rack imparts a "roll out" S-shaped flow to the first separated forms so that the same stack easily and smoothly according to its memory. The first separated forms are prevented from adhering to the carbon paper by the baffle rack, and the previous action of the splitter releases the paper locks and carbon glue from the first separated form.

PREFERRED EMBODIMENT OF THE INVENTION

Figure 1:
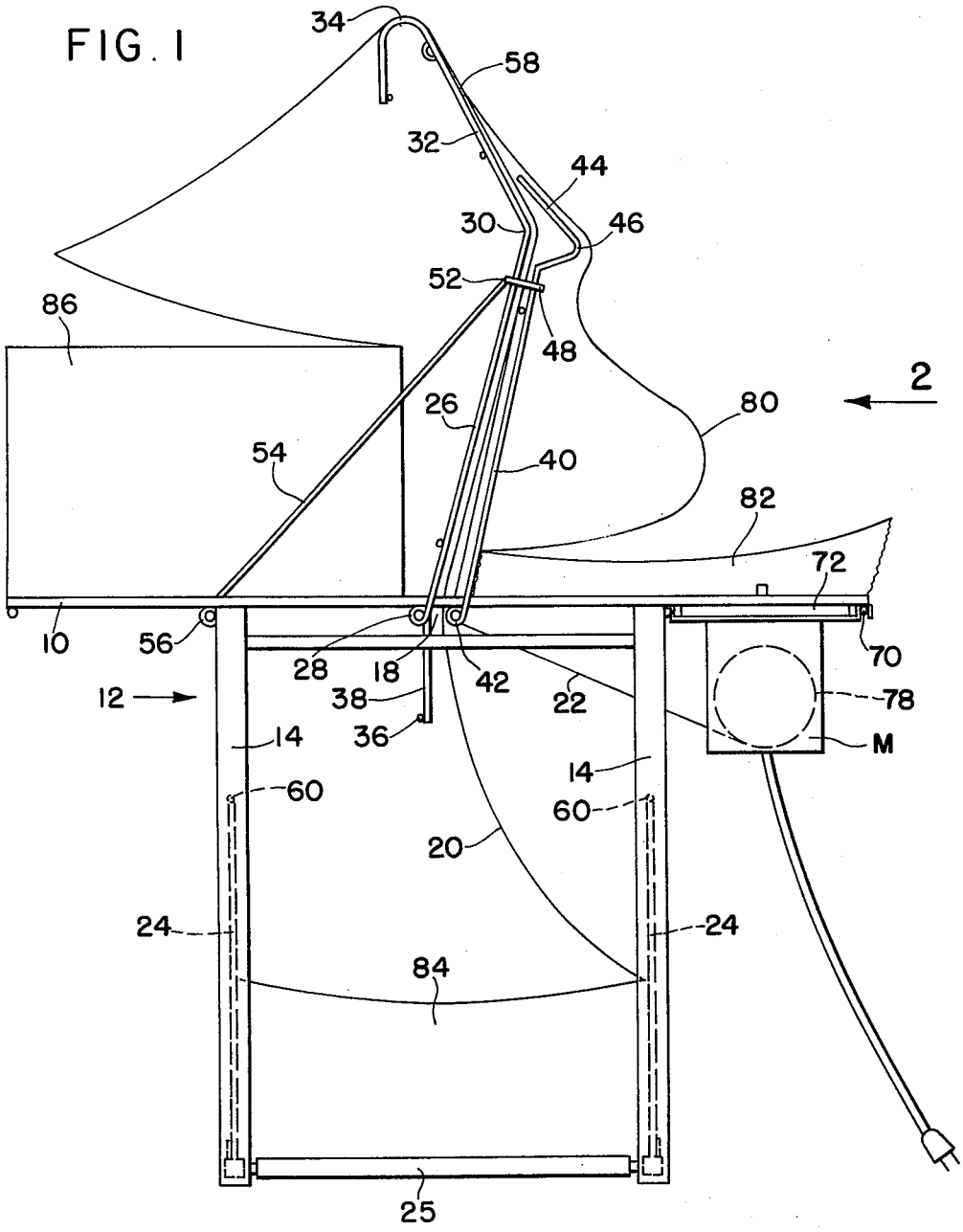
FIG. 1 is a view in side elevation showing the new decollator mounted on a stand.

The decollator of this invention is made up mainly of wire racks or frames formed in grid-like fashion and welded. There is a horizontal wire rack or grid 10 which extends from end to end of the decollator as seen in FIG. 1. It is preferred that the outer wires should be made of heavier stock than the other wires for purposes of economy and strength, etc. This frame may be rectangular or square and is mounted in any way desired, as on an open stand or the like 12 made up e.g. of four legs 14, 14 which may be of channel or angle iron formation but of lightweight material sufficient to hold the wire racks to be described and the form sets which are to be decollated. The wire rack 10 is horizontal and is continuous throughout except for a cross slot or interruption at 18 generally centrally thereof for the purpose of receiving another part of the form set as at 20 and the carbon paper as at 22.

Figure 2:
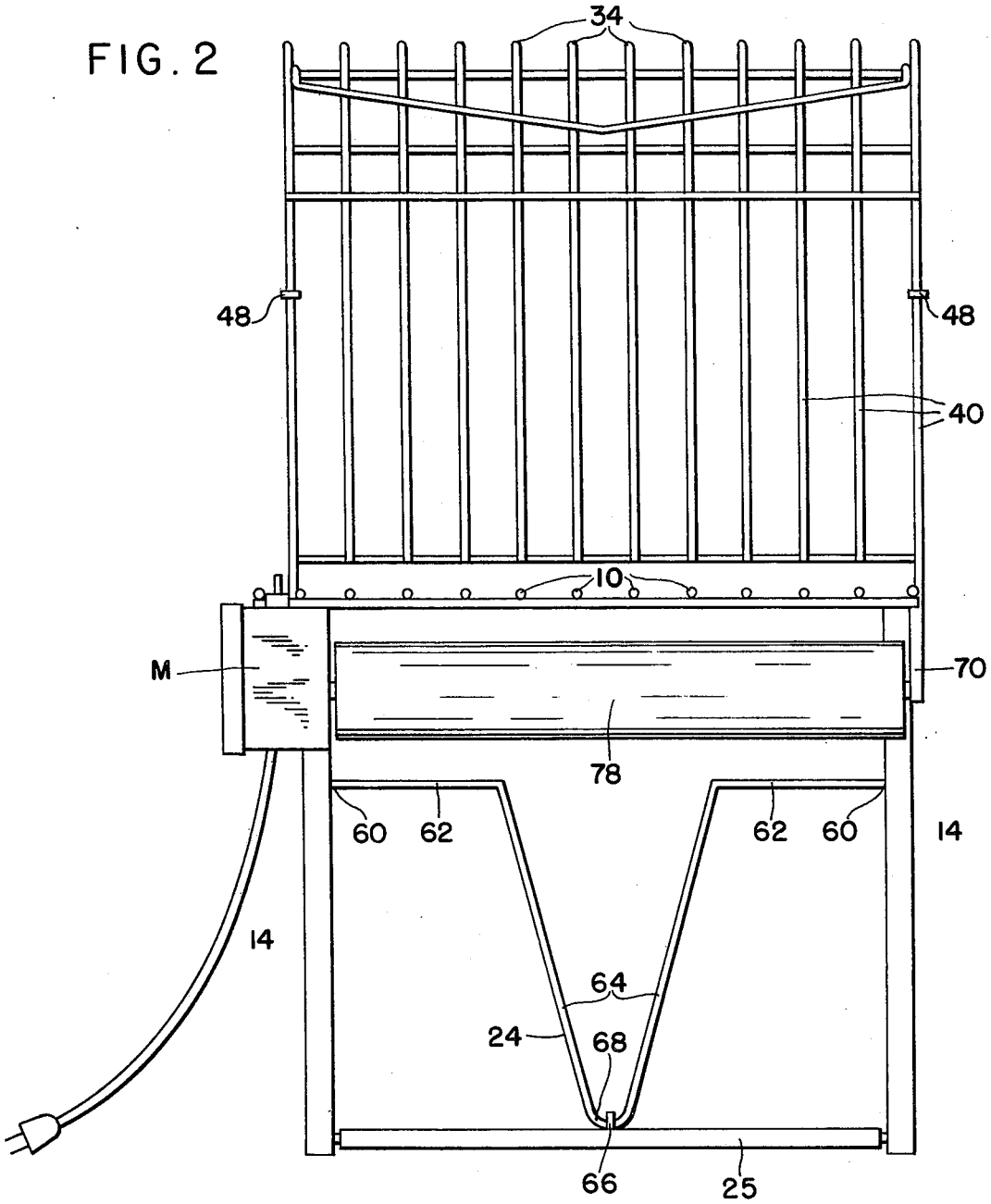
FIG. 2 is a view in rear elevation thereof looking in the direction of arrow 2 in FIG. 1.

Two wire retainer frames 24, see particularly FIG. 2, are pivotally mounted on the side legs 14 and contain the second etc., part of the form set which descends and falls according to memory being deposited on a bottom rack or plate 25.

A wire rack 26 also in grid form is pivotally mounted as by eyes 28 on a cross wire forming a part of the rack 10. Rack 26 in operative position thereof rises on an incline upwardly and to the right as seen in FIG. 1 forming a reverse turn or elbow at 30 leading into another stretch of the same gridlike formation 32 and on a reverse incline, terminating in an arc 34 guiding the form sets. If desired a stop 36 may be provided on any convenient location to be abutted by means of a terminal portion or tail 38 of an outside wire or rack 26. In shipping or storage condition the rack 26 may be put down generally flat with the terminal portion 38 thereof abutting the underside of rack 10 at the right hand side of rack 26.

Another wire grid rack 40 is pivoted on a crosswire at 42 similarly to the pivot construction of rack 26. Rack 40 rises not quite parallel to rack 26 gradually converging with respect to the same as it goes up and terminates in an offset triangular formation 44 having an apex 46. The wire rack 40 is connected to wire rack 26 by means of a lightweight clip 48 having two apertures 50, 50 therein. A crosswire at 52 forming part of the wire rack 26 receives an end hook on a wire 54 pivoted at 56 to a cross piece on wire rack 10 so that in operative position these parts are all held erect as shown in FIG. 1.

In addition, the portion 32 of rack 26 is provided with a splitter 58 and this is used to separate the paper locks and to disrupt the carbon glue.

The wire retainers 24, 24 are pivoted as at 50 to legs 14, 14 of the stand upon which the decollator is mounted. These retainers each comprise a single piece of wire extending inwardly along portions thereof at 62, 62 and then downwardly in a V-shaped formation at 64 providing manual access to the stack. The plate 25 is provided with a series of holes receiving removable stop pins 66 for locating the ends 68 of the wire retainers in the positions as indicated for instance in dotted and solid lines in FIG. 1 so as to accommodate and retain form sets of different sizes.

Figure 3:
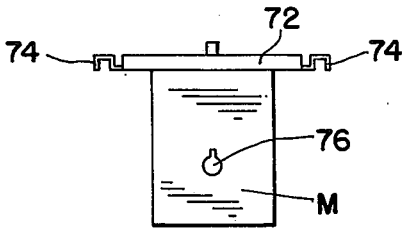
FIG. 3 is a detail illustrating the motor mount.
Figure 4:
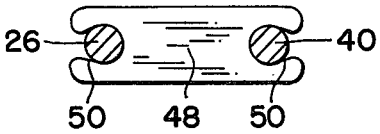
FIG. 4 is a detail of the lock between parts of the inclined rack.

The rack 10 also includes a pair of spaced parallel relatively heavy cross wires 70, 70 and these support the motor M on a mounting plate 72, see FIG. 3. Plate 62 has inverted edge channels 74, 74 that are parallel and spaced apart a distance to snap onto wires 70, suspending the motor M in the position shown for instance in FIG. 2. The motor M is provided with an opening or chuck arrangement 76 for the reception of a shaft of a takeup core or roll 78, the opposite end of the roll being mounted on a depending bracket 70 and being removable therefrom.

In the operation of the decollator, the operator starts the splitting action, the form set being decollated being indicated by the reference numeral 80, and it is deposited in an S-shaped flow stacking as at 82 on the right hand side of the wire rack 10. At the same time the carbon or second form set and the carbon paper descend in the passage created by the two wire racks 26 and 40 as shown in FIG. 1. The carbon paper is taken up on roll 28 which when full is easily removed and discarded and a new roll applied and the second form set flows smoothly down as at 20 folding in a stack at 84 for subsequent decollating or running through the machine once more.

The original stack is indicated by the reference numeral 86 and is mounted on the left hand part of the rack 10. Once the action is correctly started it continues smoothly to the end. The memory of the paper causes it to refold as it was previously, the triangular guide correctly positioning it, and this may be assisted by a current of air flowing downwardly induced by the traveling carbon and paper feeding to the stacks. The open spaces in the wire racks assist in the passage of air and produce a very tight stack reducing friction and consequent static electricity. Static electricity may also be reduced by forming the disposable core 78 of the plasticized material and wires can be associated therewith and grounded if this should be found to be necessary.

The entire device is extremely simple and inexpensive. It operates smoothly and rapidly due to the angle of the wire racks 26 and 40 with respect to the horizontal and the triangular device 44, 46 which is in effect a guide for the decollated forms in the S-shaped flow at 80. By adjusting the retaining wire 24, the receptacle on plate 25 can be adjustable to compensate for various step form sizes, retaining the forms with the refold thereof in the center of the stand.

I claim:

1. A decollator for decollating a stack of continuous folded manifold forms including in detachably connected layers at least a first form set, a second form set and a carbon web between said first and second form sets, said decollator comprising a first generally horizontal wire rack including a plurality of spaced wires forming a grid-like member, an elongated opening formed generally centrally in said first wire rack, a second wire rack pivotally mounted on said first wire rack, means holding said second wire rack in a vertically inclined position on said first wire rack, a third wire rack pivoted on said first wire rack spaced from and adjacent to said second wire rack and extending upwardly and converging slightly toward said second wire rack, said second and third racks being located respectively on opposite sides of said elongated opening and forming a passage between them to guide said second form set and said carbon web through said elongated opening, said second wire rack having a curved top for guiding said manifold forms over said second wire rack, said third wire rack having an offset upper portion terminating below said curved top of said second wire rack, splitter means on said second wire rack between the curved top thereof and said offset upper portion of said third rack for separating said first form set from said carbon web and said second form set, means beneath said first wire rack for accumulating said carbon web, and receiver means beneath said first wire rack for receiving said second form set, said first generally horizontal wire rack having first and second support surfaces separated by said second and third wire racks, said first support surface being located adjacent said second wire rack and providing support for a stack of said continuous folded manifold forms, said second support surface being located adjacent said third wire rack and providing support for a decollated stack of said first form set, said offset upper portion on the third wire rack guiding the decollated first form set to a folded stack on said second support surface, said means for accumulating said carbon web comprising a motor and a rotary core driven by said motor for rolling up the carbon web thereon and traveling said first and second form sets.

2. The decollator of claim 1 including means for quick dismount of said motor and said core.

3. The decollator of claim 2 wherein said means for quick dismount of the motor and core includes spaced parallel wire members and inverted channel shaped mounts corresponding thereto secured with respect to the motor, said inverted channels receiving the wire members.

4. The decollator of claim 1 including a stand for supporting said first rack said stand having four substantially parallel legs each located in a different corner of a rectangle, a first pair of said legs depending from said first wire rack on one side of and in a plane substantially parallel to said elongated opening, and a second pair of said legs depending from said first wire rack on the other side of and in a plane substantially parallel to said elongated opening, a pair of wire retaining members located below said first wire rack, said retaining members having axially aligned spaced pivot portions and a V-shaped formation depending from said pivot portions, said V-shaped formation having an apex remote from said pivot portions and a pair of legs diverging from said apex toward said pivot portions, first pivot mounting means for pivotally supporting one of said retaining members by its pivot portions between said first pair of legs and second pivot mounting means for pivotally supporting the other of said retaining members by its pivot portions between said second pair of legs.

5. The decollator of claim 1 including means for engaging the apex of the V-shaped formation at different distances inwardly with respect to the pivot mounting means for said retainers.

6. A decollator for decollating a stack of continuous zigzag folded manifold forms including in detachably connected layers at least a first form set, a second form set and a carbon web between said first and second form sets, said decollator comprising a planar support having a first surface portion for supporting a stack of the folded manifold forms to be decollated, a second surface portion for supporting a stack of the decollated first form set, and an elongated aperture between said first and second surface portions for the passage of the decollated carbon web and the second form set, means for supporting said planar support in a substantially horizontal plane above an underlying surface, a first upstanding wire rack supported on said planar support along said elongated aperture and said first surface portion, said first upstanding wire rack having an upstanding base portion which inclines upwardly over said second surface portion and an upper portion extending from said base portion which inclines upwardly in a direction over said first surface portion, said upper portion of said first wire rack having curved guide means at its upper extremity for guiding said continuous manifold forms over the top of said upper portion of said first wire rack and down behind same, splitter means provided on said upper portion of said first wire rack for separating said first form set from said carbon web and said second form set, a second upstanding wire rack supported on said planar support along said elongated aperture and said second surface portion, said second upstanding wire rack including a base portion spaced from said base portion of said first upstanding wire rack and an offset terminal portion which is spaced from and converges toward said upper portion of said first wire rack, said second upstanding wire rack providing a guide for the decollated first form set to guide same into a stack on said second surface portion, receiver means below said planar support surface for receiving said second form set, and roll up means below said planar support for rolling up said carbon web, said first and second upstanding wire racks forming between them a chute for guiding said second form set and said carbon web through said elongated aperture in said planar support.

7. The decollator of claim 6 wherein said roll up means comprises a detachable core and means to drive the core.

8. The decollator of claim 7 including means to removably mount said core.

9. The decollator of claim 6 wherein said means for supporting said planar support comprises a stand and means securing said planar suport to said stand.

10. The decollator of claim 9 wherein said receiver means for receiving said second form set is located in said stand.

11. The decollator of claim 6 wherein said first and second wire racks are pivoted on said planar support and including releasable means for supporting said first and second wire racks in upstanding position and for releasing said first and second racks for folding down against said planar support for storage and shipping.

* * * * *